US006184302B1

(12) United States Patent
Eyrisch

(10) Patent No.: US 6,184,302 B1
(45) Date of Patent: Feb. 6, 2001

(54) SUBSTANTIALLY WATER-INSOLUBLE CATIONIZED SOLIDS, AND THEIR PREPARATION AND USE

(75) Inventor: Oliver Eyrisch, Essen (DE)

(73) Assignee: Clariant Corporation, Frankfurt (DE)

( * ) Notice: Under 35 U.S.C. 154(b), the term of this patent shall be extended for 0 days.

(21) Appl. No.: 09/075,657

(22) Filed: May 11, 1998

(30) Foreign Application Priority Data

May 12, 1997 (DE) ..... 197 19 899

(51) Int. Cl.[7] ..... C05J 271/02; C05J 251/00; C05J 126/06; C08G 73/00; C08G 73/06

(52) U.S. Cl. ..... 525/279; 525/259; 525/326.7; 528/422; 528/423

(58) Field of Search ..... 525/326.7, 279, 525/259, 327.6; 528/422, 423

(56) References Cited

U.S. PATENT DOCUMENTS

| | | | | |
|---|---|---|---|---|
| 5,076,846 | * | 12/1991 | Buri et al. | 106/401 |
| 5,152,906 | * | 10/1992 | Aften et al. | 507/222 |
| 5,211,854 | | 5/1993 | Liao et al. | 210/734 |
| 5,447,604 | * | 9/1995 | Johansson et al. | 162/181.6 |
| 5,518,585 | * | 5/1996 | Huth et al. | 162/168.2 |
| 5,543,056 | * | 8/1996 | Murcott et al. | 210/705 |
| 5,755,930 | * | 5/1998 | Satterfield et al. | 162/164.1 |

FOREIGN PATENT DOCUMENTS

| | | |
|---|---|---|
| 4200133 | 7/1993 | (DE) . |
| 4200136 | 7/1993 | (DE) . |
| 4200139 | 7/1993 | (DE) . |
| 19509982 | 9/1996 | (DE) . |
| 0041651 | 12/1981 | (EP) . |
| 0445953 | 9/1991 | (EP) . |
| 0553575 | 8/1993 | (EP) . |
| 6-212577 | 8/1994 | (JP) . |
| WO92/19652 | 11/1992 | (WO) . |
| WO96/26220 | 8/1996 | (WO) . |

OTHER PUBLICATIONS

Derwent Patent Family Report and/or Abstract.
"Polyelectrolytes", Hanser Publishers, Carl–Hanser–Verlag, 1994, pp. 11 to 66.
Das Papier 50(1986) No. 4, pp. 157 to 162.
Das Papier 50 (1996) No. 6, pp. 293 to 299.
Das Papier (1996), No. 12, pp. 729 to 734.
G.B. Butler, J. Macromol. Sci. A26, 1989, p. 681.
European Search Report.
"Herstellung von kationischen Zellstoffen durch Propfcopolymerisation, Teil 2" DAS Paper, Bd. 51, Nr. 2, Feb. 1997, Seiten 55–58, XP002076187.
"Neue Wege Zur Kationisierung Von Cellulose New Ways To Cationic Cellulose" Papier, DAS, Bd. 50, Nr. 12, Dec. 1996, Seiten 729–734, XP000637316.

* cited by examiner

*Primary Examiner*—David W. Wu
*Assistant Examiner*—Tanya Zalukaeva
(74) *Attorney, Agent, or Firm*—Miles B. Dearth; Scott E. Hanf

(57) ABSTRACT

The present invention relates to water-insoluble cationized solids obtained by treating solids with cationic homopolymers and/or copolymers comprising allylic and/or vinylic double bonds, where cationization is carried out using nitrogen-containing cationic polymers and/or copolymers which comprise from 0.5 to 100 mol-%, preferably from 5 to 20 mol-%, of said double bonds, based on nitrogen equivalents. The invention relates in particular to cationized solids obtained by cationization with allylated and/or vinylated derivatives of amino-containing polymers and/or copolymers. The invention also embraces the preparation of cationized solids by free-radical crosslinking of the above-mentioned cationic polymers and/or copolymers in the presence of solids. The products obtained are in general at least 95% insoluble in water. They are obtained by cationizing mineral materials and, preferably, cellulose and are used preferably as retention aids and/or fixing agents in papermaking.

12 Claims, No Drawings

SUBSTANTIALLY WATER-INSOLUBLE CATIONIZED SOLIDS, AND THEIR PREPARATION AND USE

DESCRIPTION

Crosslinkable polyelectrolytes have acquired great importance in diverse fields of use, especially in the textiles and paper sector. Particular technical advantages are offered by polymers and copolymers that possess quaternary ammonium groups, which can be anchored to various substrates by way of reactive structural units (see, for example, "Polyelectrolytes", Hanser Publishers, Carl-Hanser-Verlag, 1994, pages 11 to 66).

Crosslinkable polyelectrolytes are outstandingly suitable for the surface modification of water-insoluble solids in that they either crosslink with themselves, so becoming insoluble in water and, given appropriate treatment, being deposited them on the solid or else make it possible for the solids to be anchored by grafting onto a reactive solid, such as cellulose. Epichlorohydrin is a favorite crosslinker component for polyamines, since it is inexpensive and, owing to its dual reactivity, is highly effective. Because of the high toxicity of epichlorohydrin and the problems this entails, however, the use of this compound is becoming increasingly undesirable.

DE-A-195 09 982 describes aftertreatment compositions for textiles. This application relates to a polymeric aftertreatment composition obtained by reacting a homopolymer of diallylamine or N-methyldiallylamine or a copolymer of diallylamine and N-methyidiallylamine with an epihalohydrin, alone or in the presence of an aliphatic amine, a polyamine, or the product of reaction of an epihalohydrin with an aliphatic amine or polyamine. The process is laborious and not unhazardous owing to the toxicity of the epihalohydrins and of corresponding halohydrin derivatives.

For the normal cationization of polysaccharides (for example, starch or cellulose) it is common to use glycidyltrimethylammonium chloride. In order to provide the cellulose not only with cationic groups but also with other desirable properties, it is possible according to Gruber and Ott to carry out a reaction with epichlorohydrin and an almost arbitrary tertiary amine [Das Papier 50 (1996) No. 4, pages 157 to 162). This method, however, leads to low yields, low surface selectivity and partial crosslinking of the cellulose. Gruber and Granzow reported on the cationization of cellulose by means of cationic graft polymers obtained, for example, from diallyldimethylammonium chloride (DADMAC) and acrylamide using a free-radical initiator, where the fiber material employed is bleached beechwood sulfite cellulose [Das Papier 50 (1996) No. 6, pages 293 to 299). A good overview of the subject of cationization of cellulose is given in the journal Das Papier 50 (1996), No. 12, pages 729 to 734.

To improve the wet and dry strength of paper EP-A-41 651 proposes cationic compounds consisting of a mixture of the cations $[R_3N—CH_2—CH(OH)—CH_2X]^+$ and $[R_3N—CH_2—CHX—CH_2OH]^+$ where the radicals R are alkyl groups and X is preferably chloro.

WO-A-96 26220 describes the preparation of fibriform, cationized cellulose particles having cationic groups in their interior as well, for which preferably at least 50% of the cationic groups should be present, and immobilized, in the interior of the particles. Examples of the cationizing agents used are aluminum salts, cationic polyelectrolytes and reactive monomers, examples being 2-chloroethyltrimethylammonium salts or propoxytrimethylammonium salts. An advantage of the process is seen in the fact that the major components are stored and transported separately and not metered and mixed until directly prior to use.

WO-A-92 19652 claims fiberlike cationic polysaccharides provided with quaternary ammonium groups, which have superabsorbent properties.

JP-A-06 212577 describes a method of printing a fibrous structure consisting of cellulose fibers and/or protein fibers. The fibrous structure is treated with a solution comprising a cationic reagent of a quaternary ammonium salt which possesses at least one reactive unit from the group consisting of vinyl, acryloyl and methacryloyl, and with an initiator from the group consisting of ammonium persulfate, potassium persulfate, benzoyl peroxide and a saltlike cerium compound. Fabric treated in this way with a polymer lends itself very well to printing with azo dyes.

EP-A-553 575 claims novel cationic polyamines featuring side chains comprising hydroxy-substituted hydrocarbon segments with tertiary or quaternary amino groups. Resinous particles are obtained that consist preferably of polyalkylenepolyamines, polyamidoamines and/or polydiallylamine. These products are preferably employed for dewatering in the manufacture of paper or cardboard packaging.

In every case where polyfunctional, crosslinking comonomers are used as agents for increasing the molecular weight, however, there is a technological risk owing to the possibility of gelling. On the other hand it is impossible to avoid the production not only of highly branched polymer chains of high molecular weight but also, owing to premature termination of the reaction, of an intolerable fraction of residual monomers, and also macromolecules of relatively low molecular weight. Owing to its reduced activity in practical applications of the polyammonium salt, the low molecular weight fraction is disadvantageous.

Branched polymers can also be synthesized by a graft copolymerization technique (for example, "grafting-on"). This technique has also been applied to the synthesis of DADMAC-acrylamide copolymers (G. B. Butler, J. Macromol. Sci. A26, 1989, page 681). A copolymer of DADMAC and dihydroxyalkyl derivatives of acrylic acid is synthesized as a prepolymer, and using $Ce^{4+}$ salts as initiator the free-radical grafting of acrylamide or a mixture of acrylamide and DADMAC onto the prepolymer chain is achieved. High prepolymer concentrations are always required in order to obtain polymer yields of about 80%. From an industrial standpoint this is unacceptable.

Similarly, branched copolymers of acrylamide and cationic monomers, such as cationic, modified acrylic esters or acrylamides or diallylammonium salts, are synthesized by copolymerizing acrylamide with macromonomers of the cationic functionalized monomers having a double bond as terminal group, as described in U.S. Pat. No. 5,211,854.

In DE-A-42 00 133, DE-A-42 00 136 and DE-A-42 00 139, polymeric pyrrolidinium salts are obtained by sulfocyclo-polymerization of diallyl-, triallyl- and tetraallylammoniun salts. DE-A42 00 136, in particular, describes the synthesis of poly(N-allyl-3,4-dimethylenepyrrolidinium) salts of the formula below in which the radical R is hydrogen or alkyl.

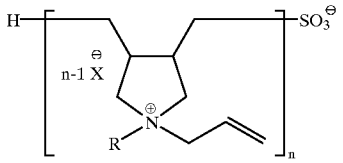

In U.S. Pat. No. 5,973,108, issued Oct. 26, 1999, water-soluble homo- or copolymers are described comprising the 1,1-diallyl-3,4-dimethylenepyrrolidinium cation as a novel structural unit in the polymer. Said application also describes copolymers comprising 1,1-dialkyl-3,4-dimethylenepyrrolidinium cations as a further unit. A further subject of said application are copolymers comprising these structural units but additionally prepared using at least one comonomer from the following group:

a) N,N-diallyidimethylammonium chloride
b) dimethylaminoethyl acrylate
c) dimethylaminoethyl methacrylate
d) dimethylaminopropylmethacrylamide
e) dimethylaminomethylacrylamide
f) acryloxyethyltrimethylammonium chloride
g) methacryloxyethyltrimethylammonium chloride
h) methacrylamidopropyltrimethylammonium chloride
i) N,N-dimethylaminoalkylcarboxylic acid allyl esters
j) acrylamide
k) methacrylamide.

The present application provides substantially water-insoluble cationized solids which are obtained by treating solids with cationic homopolymers and/or copolymers comprising allylic and/or vinylic double bonds. In accordance with the invention, the solids are cationized using nitrogen-containing cationic polymers and/or copolymers which comprise from 0.5 to 100 mol-%, preferably from 5 to 20 mol-%, of allylic and/or vinylic double bonds, based on nitrogen equivalents. By substantially water-insoluble cationized solids are meant those solids which are at least 80% and generally more than 95% insoluble in water. The ratio of insoluble to soluble measurable cationicity is at least 1, generally from 5 to 10.

For cationizing the solids it is preferred to use allylated, amine-containing cationic homopolymers and/or copolymers, allylated linear polyethyleneimines being an example. Particular preference is given to using cationic polymers comprising the N,N-diallyl-3,4-dimethylenepyrrolidinium cation as major structural unit, it being possible to vary the molar proportion of this cation within wide limits. In general the proportion is from 1 to 50 mol-%, based on nitrogen equivalents. As already mentioned, the abovementioned comonomers can also be used to prepare the nitrogen-containing cationized solids.

The substantially water-insoluble and predominantly surface-cationized solid particles of the invention are obtained by crosslinking an aqueous solution of a cationized nitrogen-containing polymer or copolymer, in the presence of substantially water-insoluble solids particles and using a free-radical initiator, with itself and/or with the particles. As free-radical initiators it is possible to use inorganic and/or organic peroxo compounds, an example being ammonium peroxodisulfate (APS), organic peroxides and peracids, and also inorganic redox systems and high-energy radiation, especially UV radiation.

The majority of the solids to be cationized are of low to very low solubility in water, whereas the water-solubility of the nitrogen-containing prepolymers used in accordance with the invention is good to very good. The reaction is therefore a heterogeneous one, which requires extremely intensive mixing of the components with one another. The reaction times are usually within the range from 1 to 12 hours. The addition of the free-radical initiator is spaced in terms of time, and is made in portions or continuously. When initiation is carried out by UV radiation, it is usual to insert a UV lamp (254 nm) into the reaction zone.

To prepare the cationized solids of sparing solubility in water it is preferred to use allylated and/or vinylated, amine-containing derivatives of polymers from the following group:

a) linear polyethyleneimines
b) polyallylamines
c) polydiallylamines
d) hydrolyzed poly-N-vinylpyrrolidones
e) hydrolyzed polyvinylcaprolactams
f) amino-containing peptides
g) chitosan.

Furthermore, the process of the invention can be used to convert a large number of solids into cationized, substantially water-insoluble compounds, preferably cellulose but also mineral substances, examples being silicon dioxide and silicic acids, silicates in chain, ribbon, leaf and/or tube form, and also clay minerals, especially bentonites. In addition to pulverulent, granular or fiberlike particles, suitable solids include carrier surfaces such as films or textiles.

The solids cationized in accordance with the invention are used preferably as retention aids and fixing agents in papermaking. The very low solubility of the solids has the technical advantage that unlike the majority of customary commercial agents the cationized solid is now discharged almost completely with the paper. In closed water circuits in papermaking, which are being used with increasing frequency on grounds of environmental protection, this has the advantage that the circuit does not become loaded with residual cationicity.

A further feature of the substantially water-insoluble, cationized solids of the invention is that the weight ratio of solid to cationizing agent is from 10 to 0.1 and, preferably, from 7 to 1.

The invention is illustrated by the following examples.

EXAMPLES

The following Example 1 for cationizing cellulose was carried out in a plowshare mixer from Gebrüder Lödige Maschinenbau GmbH.

Mode of operation: In a horizontal cylindrical container there rotate plowsharelike mixing elements which are arranged offset on a horizontal shaft. The size, number, arrangement and geometric form of the mixing tools are matched to one another in such a way that the product which is introduced into the container is set into a three-dimensional motion. The initial and final product level can be from 20 to 70% of the container volume. The mixing effect can be increased by means of separately driven, high-speed rotating blade heads or multistage blade heads. The mixer used has a heatable mixing chamber with an effective capacity of not more than 3.5 l. By way of a jacket it can be heated at up to 125° C. using a heat transfer fluid (ethylene glycol). The polymer solution, with ammonium persulfate added, is metered by means of a peristaltic pump and is sprayed through a dual-substance nozzle onto the carrier material, cellulose (type ®Arbocel B00). In order to loosen coarse agglomerates, a high-speed blade head is deployed at regular intervals. After the solution has been introduced, the mixer is operated for a further 20 minutes for further drying. Finally, the product is dewatered fully in a vacuum drier at 150° C./10 mbar.

Example 1

A copolymer prepared from 80 mol-% DADMAC and 20 mol-% diallylammonium chloride is allylated in aqueous solution with, in addition, 40 mol-% sodium hydroxide solution followed by 40 mol-% allyl chloride, based in each case on nitrogen equivalents. According to $^{13}$C-NMR analysis the resulting copolymer contains 19.5 mol-% of N,N-diallyl-3,4-dimethylenepyrrolidinium groups, based on the polymer. 105 g of this copolymer are dissolved in 590 g of water, and 3.1 g of APS are added. The plowshare mixer is charged with 243 g of cellulose powder. With the mixer running, the copolymer solution is sprayed in at a mixing-chamber temperature of from 88 to 96° C. and with a rate of addition of from 10 to 15 g/min. Complete drying gives 345 g of cationized cellulose as a white powder. The product is not soluble in water. Following resuspension in water, 18% of the originally introduced cationicity is still detectable in the supernatant solution.

Example 2

First of all, in a known manner, a water-soluble copolymer is prepared from 0.5 mol of DADMAC, 0.5 mol of diallylamine and 0.5 mol of aqueous hydrochloric acid, with the addition of 0.015 mol of APS. Subsequently, 14.4 g (0.18 mol) of 50% strength sodium hydroxide solution are added at room temperature to 63.8 g (0.18 mol nitrogen equivalents) of this copolymer. The copolymer is then allylated by adding 13.8 g (0.18 mol) of allyl chloride, in portions, over the course of 3 hours at 50° C. The resulting, water-soluble, random copolymer essentially comprises the following structural units, in which n and m are 1:

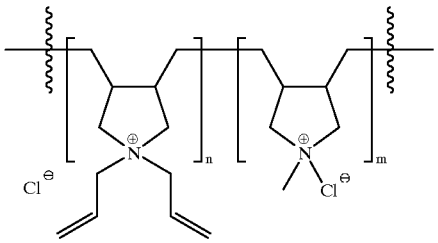

A solution of 32.3 g of this copolymer in 300 ml of deionized water is introduced into a cylindrical, vertical 2 l reactor which has a jacket for heating/cooling and has been provided with a ®Turrax stirrer. With the stirrer running, the reactor is flushed with an inert gas ($N_2$), in the course of which the temperature rises to 80° C. owing to the stirring energy introduced. The temperature is then kept constant by external cooling. Finely divided, ground cellulose is added in four portions over the course of 3 hours (200 g of ®Arbocel B00 in total), while at the same time a solution of 2.5 g of APS in 100 ml of water is added, likewise in portions. The cellulose and the initiator are added over the course of 3 hours with subsequent postreaction for a period of 1 hour at 90° C. After cooling to 20° C., the cationized cellulose is filtered off over a fine-meshed filter, washed with 100 ml of water and finally dried to constant weight at 105° C./10 mbar. The yield of water-insoluble, cationized cellulose is 212 g (91.3% of theory). Following resuspension in water, 12% of the originally introduced cationicity is still detectable in the supernatant solution.

Example 3

A 500 ml stirred apparatus is charged with 200 g (1.163 mol) of ®Polymin P (a 50% strength aqueous solution of a polyethyleneimine homopolymer), and this initial charge is heated to 50° C. With stirring, a total of 93.4 g (1.215 mol) of allyl chloride and 100 ml of water are added at 50° C. over the course of approximately 10 hours, and stirring is continued for 3 hours. The excess of allyl chloride is subsequently stripped off in vacuo. This gives an aqueous solution of 189 g of the allylated, cationic polyethyleneimine. This solution is transferred to the ®Turrax apparatus used in Example 2 and is mixed, with stirring, with a suspension of 200 g of ®Tixoton (an activated calcium bentonite) in 1200 ml of deionized water. Still with stirring, the suspension is saturated with nitrogen, and a solution of a total of 15 g of APS is metered in over the course of 5 hours at from 70 to 80° C., in the course of which the dispersion becomes somewhat lighter in color. The product is separated off in a centrifuge and dried to constant weight at 105° C./10 mbar. The yield of water-insoluble, cationized bentonite is 381 g (97.9% of theory).

I claim:

1. A substantially water-insoluble cationized solid obtained by treating a solid with a nitrogen-containing cationic polymer and/or copolymer, said polymer and/or copolymer contains structural units from 1,1-diallyl-3,4-dimethylenepyrrolidinium, and which comprises from 0.5 to 100 mol-% of allylic and/or vinylic double bonds, based on nitrogen equivalents.

2. Substantially water-insoluble cationized solids selected from the group consisting of mineral substances, cellulose, clay minerals, granular particles, fiberlike particles, films and textiles, obtained by treating said solids with a nitrogen-containing cationic polymer and/or copolymer, said polymer and/or copolymer contains structural units from 1,1-diallyl-3,4-dimethylenepyrrolidinium, and which comprises from 0.5 to 100 mol-% of allylic and/or vinylic double bonds, based on nitrogen equivalents.

3. A cationized solid as claimed in claim 2, wherein the solid is cationized using a nitrogen-containing cationic copolymer which in addition to the structural units derived from 1,1-diallyl-3,4-dimethylene-pyrrolidinium contains structural units derived from at least one of the following group of monomers:

a) N,N-diallyldimethylammonium chloride
b) dimethylaminoethyl acrylate
c) dimethylaminoethyl methacrylate
d) dimethylaminopropylmethacrylamide
e) dimethylaminomethylacrylamide
f) acryloxyethyltrimethylammonium chloride
g) methacryloxyethyltrimethylammonium chloride
h) methacrylamidopropyltrimethylammonium chloride
i) N,N-dimethylaminoalkylcarboxylic acid allyl esters
j) acrylamide
k) methacrylamide.

4. A cationized solid as claimed in claim 2, wherein the solid used is cellulose.

5. A cationized solid as claimed in claim 2, wherein the solid used is a mineral material.

6. A cationized solid as claimed in claim 2, which is obtained by cationizing a mineral selected from the group consisting of silicon dioxide, silicic acids, the silicates and clay minerals.

7. A substantially water-insoluble cationized solid as claimed in claim 2 wherein the weight ratio of solid to cationizing agent is from 10 to 0.1.

8. The cationized solid of claim 6 wherein said clay mineral is bentonite.

9. The cationized solid of claim 2 wherein said allylic and/or vinylic double bonds, based on nitrogen equivalents are present at from 5 to 20 mol-%.

10. A process for preparing substantially water-insoluble, surface-cationized solids particles as set forth in claim 1 which comprises crosslinking an aqueous solution of the cationic, nitrogen-containing polymer or copolymer, in the presence of substantially water-insoluble solids particles and using a free radical initiator, with itself and/or with the solids particles.

11. The process as claimed in claim 10, wherein the free-radical initiator is selected from the group consisting of inorganic and/or organic peroxo-compounds, inorganic and/or organic persulfates, inorganic redox initiator systems and high energy rays.

12. A process for making paper comprising adding the cationized solids of claim 1 in said process as a retention aid or fixing agent.

* * * * *